United States Patent [19]

Bowers

[11] Patent Number: 4,719,853

[45] Date of Patent: Jan. 19, 1988

[54] CODING BOX WITH SELECTIVELY ADJUSTABLE PRINTING WHEELS

[75] Inventor: John G. Bowers, Leicester, England

[73] Assignee: R. E. Bowers & Freeman Limited, Leicester, England

[21] Appl. No.: 938,972

[22] Filed: Dec. 8, 1986

[30] Foreign Application Priority Data

Dec. 16, 1985 [GB] United Kingdom ..... 8530934

[51] Int. Cl.[4] ..... B41J 1/60

[52] U.S. Cl. ..... 101/110; 101/29; 101/382 MV

[58] Field of Search ..... 101/29, 31, 21, 110, 101/99-101, 106-108, 95-97, 382 MV

[56] References Cited

U.S. PATENT DOCUMENTS

| | | | |
|---|---|---|---|
| 18,249 | 9/1857 | Robertson | 101/110 |
| 848,887 | 4/1907 | Earle | 101/106 |
| 988,242 | 3/1911 | Blitz | 101/110 |
| 1,289,539 | 12/1918 | Powers | 101/29 |
| 1,446,013 | 2/1923 | Lawrence et al. | 101/96 |
| 2,506,729 | 5/1950 | Morin | 101/110 |
| 4,228,736 | 10/1980 | Griffiths | 101/382 MV |

*Primary Examiner*—Clifford D. Crowder

*Attorney, Agent, or Firm*—Kalish & Gilster

[57] ABSTRACT

A coding box suitable for a hot foil printing machine comprises a frame, a number of print wheels rotatable about a shaft with respect to the frame, each print wheel having a number of outward-facing peripheral flats bearing indicia, a through-hole parallel to the shaft and corresponding to each flat, a rod passable through the holes for setting the wheels in desired orientations with respect to the frame and a magnet in a cup for locking the rod in a set position. A second rod is provided, fast with respect to and parallel to the first rod and having an enlarged distal end for engagement with a hole in the frame to prevent complete removal of the first rod from the frame. The first and second rods are both fast in a handle by which they may be withdrawn from the wheels to permit rotation of the wheels, and thus variation of the indicia to be stamped.

4 Claims, 14 Drawing Figures

CODING BOX WITH SELECTIVELY ADJUSTABLE PRINTING WHEELS

DESCRIPTION

1. Technical Field

The invention relates to coding boxes for hot foil printing machines. Such machines are generally used for "use by" dating or stamping other indicia onto packages, particularly to packages containing perishables. The coding box is adjustable to vary the indicia stamped.

2. Background Art

Coding boxes comprise a frame for bolting onto a printing machine. One previously known kind of box comprises also a number of print wheels, each having a number of outward-facing peripheral flats, and each flat bearing an individual digit, letter or character. The print wheels are all rotatable about a single axis with respect to the frame, and provided with spring-loaded centring means to ensure that the printing is even. One of the problems is that in operation the vibration eventually tends to wear the mechanism, so that the wheels spin loose and crash, the printing is uneven and the substrate package may be damaged.

THE INVENTION

A coding box according to the invention comprises a frame, a number of print wheels rotatable about a shaft with respect to the frame, each print wheel having a number of outward-facing peripheral flats bearing indicia, characterized by each wheel having a through-hole parallel to the shaft and corresponding to each flat, a rod passable through the holes for setting the wheels in desired orientations with respect to the frame, and means for locking the rod in a set position.

A second rod is preferably provided, fast with respect to and parallel to the first rod, and having an enlarged distal end for engagement with a hole in the frame to prevent complete removal of the first rod from the frame. The first and second rods are preferably both fast in a handle by which they may be withdrawn from the wheels to permit rotation of the wheels, and thus variation of the indicia to be stamped. The handle is preferably of heat-resistant material such as PTFE. The locking means may comprise a magnetic part of the handle which is attracted towards the frame (which is generally of ferrous metal). The block is preferably provided with one or more spacers between adjacent print wheels to allow a little flexibility and facilitate the mounting of the wheels in the frame. The wheels and spacers are usually made of brass because of its machinability.

The first rod passing through the holes in the printing wheels provides positive engagement for aligning the faces on the wheels, and hence ensuring even printing, without the involvement of any spring. The locking means reduces noises from relative movement between parts in use, and hence wear. A coding box according to the invention may be constructed so as to have no removable parts; this makes for safety and reliability.

The wheels may for example have ten flats each bearing a single digit from 0 to 9. Alternatively, the wheels may have eleven flats so that a blank may be included. Another possibility is for the wheels to have twelve flats and be made wide enough for each flat to bear the name of a month or the whole of an abbreviation therefor.

The magnet should be heat resistant, and may be small in relation to the other components of the coding box, and may be made to adhere to a part of the handle adjacent the frame. The magnet itself is preferably protected against damage through impact or wear by being mounted in a mild steel cup which itself adheres in a recess to the handle.

DRAWINGS

Figure 1:
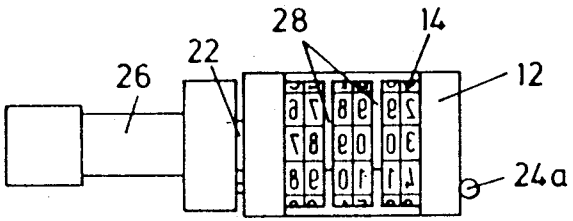
FIG. 1 is a top view of a coding box according to the invention in a closed or operative position.
Figure 2:
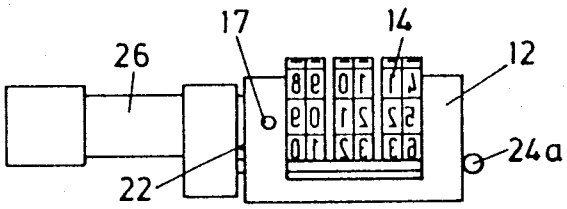
FIG. 2 is a side view of the coding box shown in FIG. 1.
Figure 3:
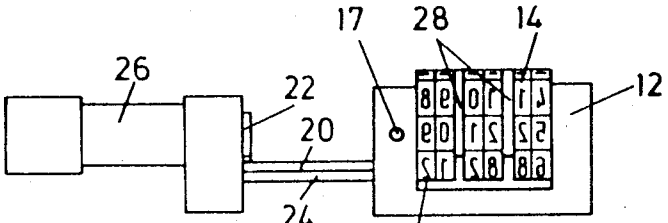
Figure 2B:
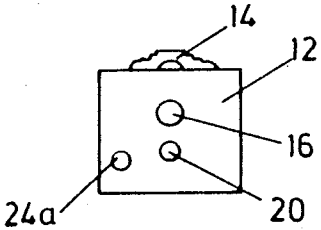
Figure 2A:
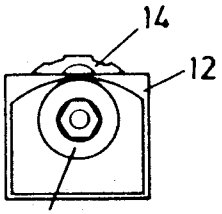
Figure 4:
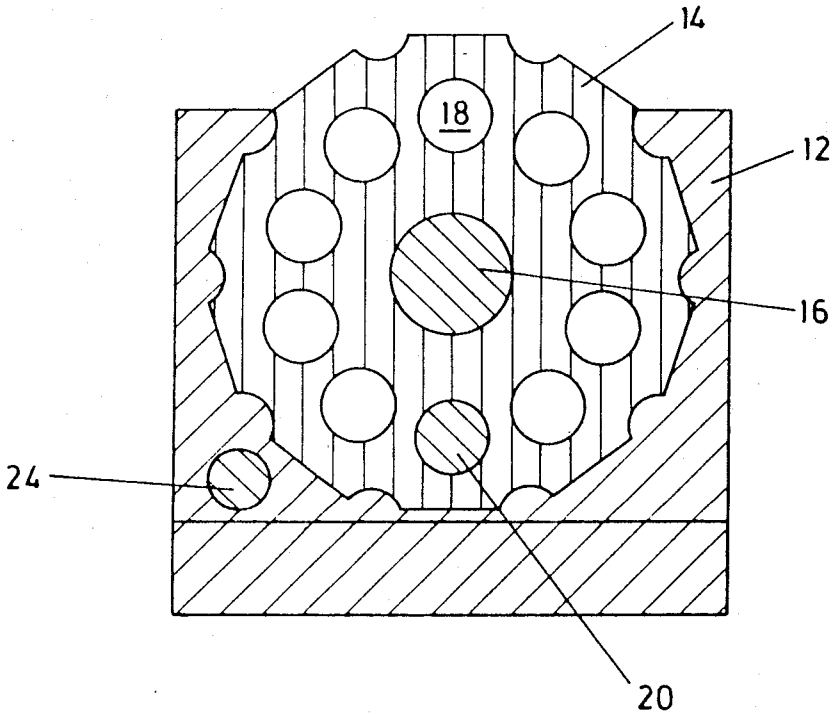
Figure 5:
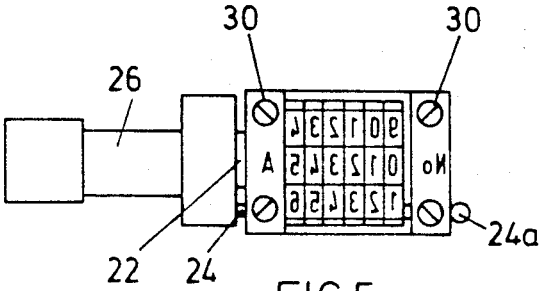
Figure 6:
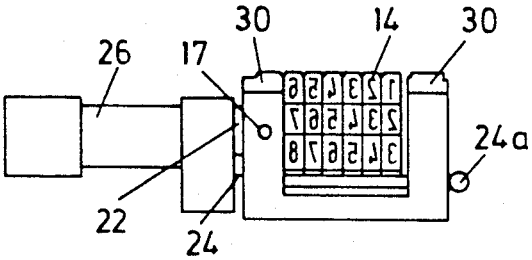
Figure 7:
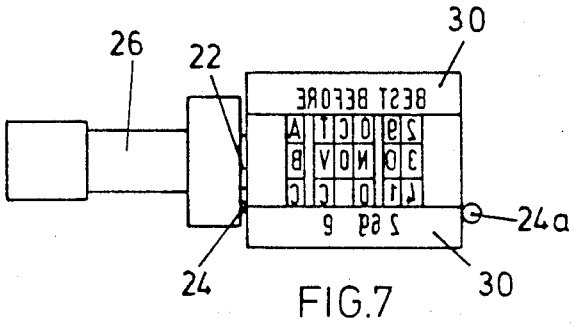
Figure 8:
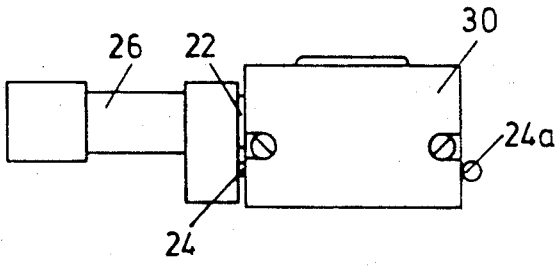
Figure 8A:
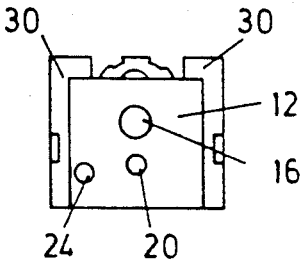
Figure 9:
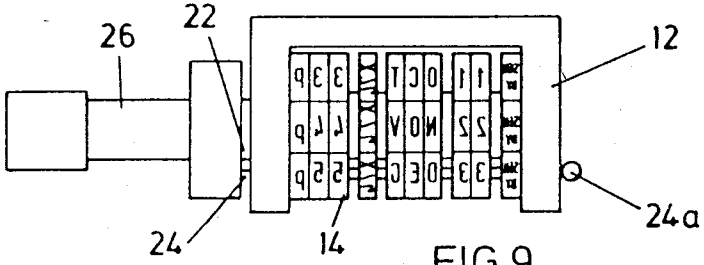
Figure 10A:
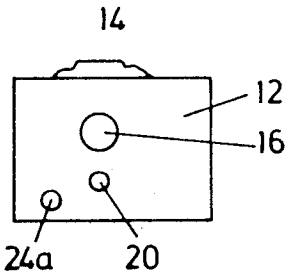
Figure 10:
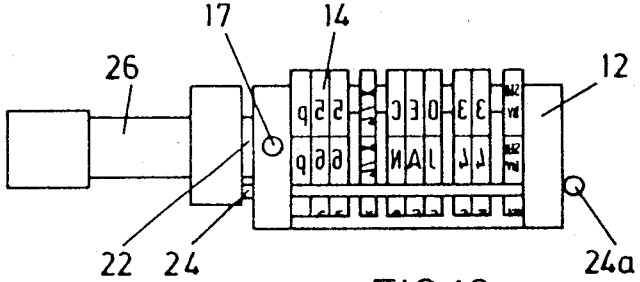

FIGS. 2*a*, 2*b* are end views of the coding box as shown in FIG. 2;

FIG. 3 is a side view of the coding box shown in FIG. 1 in an open or adjustment position;

FIG. 4 is a cross-section through a print wheel in the coding box of FIG. 1 on a larger scale in the closed position;

FIGS. 5, 6 are respectively top and side views of a first modified coding box according to the invention;

FIGS. 7, 8, 8*a* are top, side and end views respectively of second modified coding box according to the invention; and FIGS. 9, 10, 10*a* are similar views of a third modification.

BEST MODE

With reference to the drawings, the coding box comprises a mild steel frame 12 provided with screw holes (not shown) for fixing in a hot foil printing machine. A number of brass print wheels 14 are rotatable about a shaft 16 (FIG. 2*b*) secured by a screw 17 with respect to the frame 12. Each print wheel 14 has a number of outward-facing peripheral flats, which are particularly apparent in FIG. 4, bearing indicia, i.e. a digit or letter in mirror image for printing on a package.

FIG. 4 also shows how each print wheel 14 has a number of through-holes 18 parallel to the shaft 16. Each hole 18 corresponds to one of the peripheral flats on the print wheel 14. Each hole 18 as shown has a diameter coincident with a radius of the print wheel 14 normal to the corresponding flat, but this is not essential as each hole 18 could be off-set from its corresponding flat by a given amount and still enable the print wheels to be set in desired orientations. A (first) rod 20 is passable through the holes 18 for setting the print wheels 14 with respect to the frame 12.

A small magnet, which does not itself appear in the drawings adheres inside a cup 22 which itself adheres in a recess in an end face of a handle 26 of the coding box. The magnet provides means for locking the rod 20 in a set position through its attraction to an end of the shaft 16.

A (second) rod 24 projects from the handle 26, and so is fast with respect to the first rod 20 to which it is parallel. The rod 24 has an enlarged distal end 24*a* for engagement with a hole in the frame 12 to prevent complete removal of the first rod 20 from the frame 12. A number of brass spacers 28 are provided between adjacent print wheels 14.

ADJUSTMENT

The coding box is moved from the closed or operative position shown in FIG. 1 to the open or adjustment position shown in FIG. 3 by pulling the handle 26 to the left. The rods 20, 24 are thus withdrawn from the frame 12 as far as allowed by the engagement between the enlarged end 24*a* of the second rod 24 with a hold in the frame 12 as shown in FIG. 3. This leaves the print wheels 14 free for manual axial rotation to expose faces bearing the desired indicia for printing. A certain amount of slack in the holes 18 around the tip (not shown) of the first rod 20 in practice allows the rod 20 to be reintroduced into the holes 18 when not perfectly aligned, and in so doing to render the faces co-planar for even printing. When the shaft 16 and rods 20, 24 have been reintroduced into the frame 12 and once again take up the operative position shown in FIG. 1, the handle 26 is locked to the frame 12 by the magnet, and the desired indicia are exposed for printing on the top (as shown in FIG. 1) of the coding box.

In each modification, the majority of the components are the same, so a single set of reference numerals has been used throughout, and description common to all embodiments is not repeated.

In the first modified coding box of FIGS. 5 and 6, fitters 30 have been screwed to the top faces of the frame 12. The fitters 30 carry extra information, in FIG. 5 No. and A, for printing in every case at either end of the indicia exposed on the wheels 14. The fitters 30 are of a thickness such as to bring the extra information into the same plane as the indicia exposed on the wheels 14.

In the second modified coding box of FIGS. 7, 8 and 8a, fitters 30 marked BEST BEFORE and 26*g* extend along the coding box so that the extra information is printed in every case above and below the indicia exposed on the wheels 14. The fitters extend down the outside of the coding box for strength.

The third modification of FIGS. 9, 10 and 10*a* has the frame extending along a side of the coding box (the upper side in FIG. 9) and not along the base as hitherto. This makes the coining box shallower than in the preceding embodiments which is an advantage in some printing machines. The wheels 14 in this modification carry indicia showing a sell by date, characters for identification purposes, and a price.

I claim:

1. A coding box suitable for a hot foil printing machine which comprises a frame, a plurality of print wheels rotatable about a shaft with respect to the frame, each print wheel having a plurality of outward-facing peripheral flats bearing indicia, each wheel having a through-hole parallel to the shaft and corresponding to each flat, a rod passable through the holes for setting the wheels in desired orientations with respect to the frame, means for locking the rod in a set position, and a second rod fast with respect, and parallel, to the first rod and having an enlarged distal end for engagement with a hole in the frame to prevent complete removal of the first rod from the frame.

2. A coding box according to claim 1 in which the first and second rods are both fast in a handle by which they may be withdrawn from the wheels to permit rotation of the wheels, and thus variation of the indicia to be stamped.

3. A coding box according to claim 1 in which the locking means comprises a magnet which is attracted towards the frame.

4. A coding box according to claim 3 in which the locking means comprises a magnet which is attracted towards the frame.

* * * * *